US009057281B2

(12) United States Patent
Benkler et al.

(10) Patent No.: US 9,057,281 B2
(45) Date of Patent: Jun. 16, 2015

(54) AXIAL TURBOMACHINE HAVING AN AXIALLY DISPLACEABLE GUIDE-BLADE CARRIER

(75) Inventors: Francois Benkler, Ratingen (DE); Andreas Böttcher, Ratingen (DE); Uwe Kahlstorf, Mülheim a.d. Ruhr (DE); Torsten Matthias, Mülheim an der Ruhr (DE); Dieter Minninger, Dinslaken (DE); Oliver Schneider, Wesel (DE); Peter Schröder, Essen (DE); Vyacheslav Veitsman, Gelsenkirchen (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 789 days.

(21) Appl. No.: 13/260,406

(22) PCT Filed: Mar. 22, 2010

(86) PCT No.: PCT/EP2010/053663

§ 371 (c)(1), (2), (4) Date: Dec. 12, 2011

(87) PCT Pub. No.: WO2010/108876

PCT Pub. Date: Sep. 30, 2010

(65) Prior Publication Data

US 2012/0076638 A1 Mar. 29, 2012

(30) Foreign Application Priority Data

Mar. 26, 2009 (EP) ..... 09004409

(51) Int. Cl.
*F01D 1/04* (2006.01)
*F01D 11/22* (2006.01)

(52) U.S. Cl.
CPC ..... *F01D 11/22* (2013.01); *F05D 2230/64* (2013.01); *F05D 2250/314* (2013.01); *F05D 2260/50* (2013.01); *F05D 2230/644* (2013.01)

(58) Field of Classification Search
CPC ..... F01D 11/001; F01D 11/08; F01D 11/20; F01D 11/22; F05D 2230/64; F05D 2230/644; F05D 2250/314; F05D 2260/50
USPC ..... 415/126–128, 173.2, 174.1, 173.1, 415/173.3, 173.7
See application file for complete search history.

(56) References Cited

U.S. PATENT DOCUMENTS

| | | | | |
|---|---|---|---|---|
| 3,227,418 | A | 1/1966 | Harrison West | |
| 4,932,835 | A | 6/1990 | Sorokes | |
| 6,158,956 | A | 12/2000 | Arnold | |
| 6,676,372 | B2 * | 1/2004 | Scholz et al. | 415/173.2 |

(Continued)

FOREIGN PATENT DOCUMENTS

| | | | |
|---|---|---|---|
| CN | 1381670 | A | 11/2002 |
| DE | 1426818 | A1 | 3/1969 |

(Continued)

*Primary Examiner* — Edward Look
*Assistant Examiner* — Danielle M Christensen

(57) ABSTRACT

An axial turbomachine including a rotor-blade cascade is provided. The turbomachine includes a casing in which the cascade is installed and a guide-blade carrier which encloses the cascade and is integrated into the inner side of the housing. The guide-blade carrier is arranged immediately adjacently to the blade tips faulting a radial gap, wherein the guide-blade carrier is mounted in the housing, such that it may be displaced parallel to the axis of the axial turbomachine, and includes an adjusting ring which is supported on contact surfaces on the housing and guide-blade carrier and may be rotated about the axis, wherein the contact surfaces of the adjusting ring and of the housing and/or of the guide-blade carrier are set with respect to a plane perpendicular to the axis, so that, when the adjusting ring is rotated about the axis, the guide-blade carrier is displaced axially by the adjusting ring.

8 Claims, 2 Drawing Sheets

(56) References Cited

U.S. PATENT DOCUMENTS

| | | | |
|---|---|---|---|
| 2008/0063513 | A1 | 3/2008 | Afanasiev |
| 2008/0131270 | A1 | 6/2008 | Paprotna et al. |

FOREIGN PATENT DOCUMENTS

| | | | |
|---|---|---|---|
| DE | 102007003028 | A1 | 7/2008 |
| EP | 1249577 | B1 | 10/2002 |
| EP | 1900907 | A2 | 3/2008 |
| JP | 60187302 | | 9/1985 |
| JP | 2002327603 | A | 11/2002 |
| JP | 2003286992 | A | 10/2003 |
| WO | WO 2008086782 | A2 | 7/2008 |

* cited by examiner

AXIAL TURBOMACHINE HAVING AN AXIALLY DISPLACEABLE GUIDE-BLADE CARRIER

CROSS REFERENCE TO RELATED APPLICATIONS

This application is the US National Stage of International Application No. PCT/EP2010/053663, filed Mar. 22, 2010 and claims the benefit thereof. The International Application claims the benefits of European Patent Office application No. 09004409.0 EP filed Mar. 26, 2009. All of the applications are incorporated by reference herein in their entirety.

FIELD OF INVENTION

The invention refers to an axial turbomachine with an axially displaceable stator blade carrier.

BACKGROUND OF INVENTION

In an axial turbomachine, radial gaps between rotor blades and the casing lead to significant losses in thermal efficiency. In order to achieve an efficiency which is as high as possible, it is desirable to keep the radial gaps as small as possible at all operating points of the axial turbomachine. The axial turbomachine is a gas turbine, for example. During start-up and shutdown of the gas turbine, the radial gaps vary over time. Furthermore, the radial gaps vary during changeover from partial-load operation to full-load operation of the gas turbine. The gas turbine is conventionally designed in such a way that the radial gaps are of a sufficiently large dimension for the operating case in which the radial gaps are set at their smallest so that practically no contact occurs between the rotor blades and the casing. The consequence of this is that during continuous operation of the gas turbine unnecessarily large radial gaps have to be provided for this operating state, with which is associated a significant efficiency loss. the rotor, the rotor blades and the casing. Furthermore, the time-based variation of the radial gaps creates centrifugal stretch, especially of the rotor blades, transverse contraction of the rotor, possible play in the thrust bearing of the rotor, especially in conjunction with reversal of axial thrust during corresponding operating conditions of the gas turbine, and ovalization of the casing possibly occurring as a result of assembly-related prestressing and uneven heating of the casing.

It is therefore known to displace the stator blade carrier in order to set the gap width of the radial gaps. For example, laid-open specification DE 1 426 818 discloses an adjusting mechanism for displacing the stator blade carrier in the radial direction. To this end, eight longitudinally extending I-shaped segment carriers are distributed over the circumference of the axial turbine, the stator blade carrier being hooked on their inner end in a form-fitting manner. The surfaces which are in contact with each other of the flanges of the segment carriers and of the stator blade carrier are of a sawtooth-like design in order to convert a synchronous longitudinal displacement of all the segment carriers into a radial displacement of the stator blade carrier. With this, it is disadvantageous that on the one hand all the segment carriers are always to be moved synchronously in order to avoid tilting of the stator blade carrier in relation to the machine axis. On the other hand, the stator blade carrier must be designed in a segmented manner over the circumference, wherein the individual segments of the stator blade carrier are oppositely disposed, forming a gap, in order to be radially displaceable. Sealing of the gaps between the segments of the stator blade carrier is therefore very costly.

In addition, it is known from DE 10 2007 003 028 A1, for example, to axially displace the shroud ring of a gas turbine which lies opposite the rotor blade tips. For axial displacement of the shroud ring, this is of a conical form on the shroud side. A coupling ring which fits over the shroud ring is also conically foliated on the inner side. Between the two conical surfaces provision is made for cylindrical rolling elements which are oriented at an angle to the axial direction. As a result of a relative rotation of the coupling ring against the shroud ring the radial gap between the blade tips of the rotor blades and the shroud ring can be adjusted. In this case, the coupling ring, which is constructed with a relatively thick wall thickness, deforms the shroud ring, which is constructed with a relatively thin wall thickness, in the sense of an elastic deformation so that as a result of the rotation the diameter of the shroud ring can be adjusted and consequently the gap between the shroud ring and the rotor blade ring can be set. It is disadvantageous in this case that the shroud ring is elastically deformed. Also, a gap setting which is uniform over the circumference is only conditionally possible on account of the rolling elements which are distributed at a distance from each other.

Furthermore, for radial gap setting the axial displacement of guide components of a turbine by means of hydraulic pistons is known from EP 1 249 577 A1.

SUMMARY OF INVENTION

It is the object of the invention to create an axial turbomachine with high thermal efficiency, the device for radial gap setting of which is comparatively simple, reliable and accurate.

The axial turbomachine according to the invention has a rotor blade cascade, which is formed from rotor blades with a radially outer, unshrouded blade tip in each case which extends in an inclined manner to the axis of the axial turbomachine, a casing, in which the rotor blade cascade is installed and which by its inner side defines the main flow passage of the axial turbine, and a stator blade carrier which enshrouds the rotor blade cascade, is integrated in the inner side of the casing, and has a radially inner, annular inner side with which on the inner side of the casing the main flow passage is continued, and the stator blade carrier is arranged directly adjacent to the blade tips, forming a radial gap between the envelopes of the blade tips and the annular inner side, wherein the annular inner side extends essentially parallel to the blade tip and the stator blade carrier is mounted in the casing in a manner in which it is movable parallel to the axis of the axial turbomachine and also has an adjusting ring which is supported on contact surfaces on the casing and on the stator blade carrier and can be rotated around the axis of the axial turbomachine, wherein the contact surfaces of the adjusting ring and of the casing and/or of the stator blade carrier are marginally set in respect to a plane which is perpendicular to the axis of the axial turbomachine in such a way that if the adjusting ring is rotated around the axis of the axial turbomachine the stator blade carrier can be axially displaced by means of the adjusting ring.

If the axial turbomachine is an axial compressor, for example, then the critical operating state with regard to the radial gaps is during hot starting. If the axial turbomachine is an axial turbine, for example, then the critical operating state with regard to the radial gaps is during cold starting. Until the components of the casing have correspondingly warmed through and have thermally expanded to a larger diameter after startup, there is the risk of the rotor blades brushing against the casing by their blade tips. The critical operating phase during which small radial gaps can be expected is about 5 to 10 minutes. The stator blade carrier, which according to the invention is designed to be axially displaceable in the axial turbomachine and is axially displaceable by means of the adjusting ring, provides a remedy. Owing to the fact that the annular inner side and the blade tips are arranged in an inclined manner to the axis of the axial turbomachine, an alteration of the radial gap can be made by means of a corresponding axial displacement of the stator blade carrier. Therefore, by means of a suitable operation of the adjusting ring the dimension of the radial gap can be momentarily adapted to the correspondingly prevailing operating state of the axial turbomachine, wherein a radial gap which is as small as possible is always to be aimed at. Consequently, the thermal efficiency is high in all operating states of the axial turbomachine.

When designing the radial gaps of the axial turbomachine according to the invention, consideration of the criterion of "pinch point" during cold starting can be dispensed with. The axial turbomachine according to the invention may also additionally have a known device for setting the radial gaps during operation of the axial turbomachine, so that the conventional device and the operation according to the invention of the adjusting ring can be operated side-by-side at the same time for suitable axial displacement of the stator blade carrier. After getting past the starting phase of the axial turbomachine, after warming-through of the components has taken place, the stator blade carrier can be brought into its original starting position by means of a corresponding operation of the adjusting ring. Only during critical operating phases, for example, can the stator blade carrier be correspondingly displaced.

The stator blade carrier has an outwardly radially extending, encompassing stator blade carrier step with an outwardly open annular slot in which engages an inwardly radially extending, encompassing casing step, wherein the adjusting ring is arranged in the annular slot between the stator blade carrier step and the casing step. The adjusting ring bears preferably against the base of the annular slot, as a result of which the adjusting ring is supported radially by the annular slot during rotation. It is preferred that between the adjusting ring and the casing step provision is made for a fixing ring which is fastened on the casing step and interacts with the adjusting ring for axial displacement of the stator blade carrier.

The fixing ring, on its side facing the adjusting ring, has a first sawtooth profile and the adjusting ring, on its side facing the fixing ring, preferably has a second sawtooth profile, wherein the sawtooth profiles engage with each other and can slide on each other in such a way that if the adjusting ring is axially rotated the stator blade carrier is axially displaced. Induced as a result of the sawtooth profiles of the two rings, an axially variable dimension is created between the casing step and the stator blade carrier step. As a result, by operating the adjusting ring the stator blade carrier can be axially displaced.

The fixing ring is preferably fastened on the casing step in a form-fitting manner. The form-fitting fastening of the fixing ring can be realized by means of a radially extending slot, for example, which is provided in the casing step and into which engages a correspondingly conformably designed projection of the fixing ring. As a result, the fixing ring is fixed on the casing step in the circumferential direction.

The adjusting ring is preferably supported on the fixing ring by a rolling bearing which is provided between the sawtooth profiles. The rotational axes of the rolling bearings lie in the radial direction of the turbomachine. As a result of the rolling bearings, rubbing and wear on the sawtooth profiles during operation of the adjusting ring are minimized, as a result of which the adjusting ring and the fixing ring have a long service life.

Provision is preferably made in the annular slot for a pretensioning device which is supported on the casing and acts on the stator blade carrier step in counteraction to the adjusting ring so that by means of the pretensioning device the stator blade carrier step is constantly pressed onto the adjusting ring. Consequently, a restoring movement of the stator blade carrier, induced as a result of a corresponding restoring force, can be brought about by the pretensioning device, as a result of which the stator blade carrier can be reliably moved axially back and forth by the adjusting ring. The pretensioning device is preferably a helical spring.

The annular inner side preferably tapers against the main flow direction and the adjusting ring is preferably arranged on the casing step on the upstream side. Consequently, during displacement of the stator blade carrier in the main flow direction by the adjusting ring a pressure force can be exerted in said main flow direction. On the downstream side, the pretensioning device is preferably arranged on the casing step. For adjusting the adjusting ring, provision is preferably made for an adjusting rod and/or for a hydraulic ram.

BRIEF DESCRIPTION OF THE DRAWINGS

A preferred embodiment of the axial turbomachine according to the invention is explained in the following text with reference to the attached schematic drawings. In the drawings.

DETAILED DESCRIPTION OF INVENTION

Figure 2:
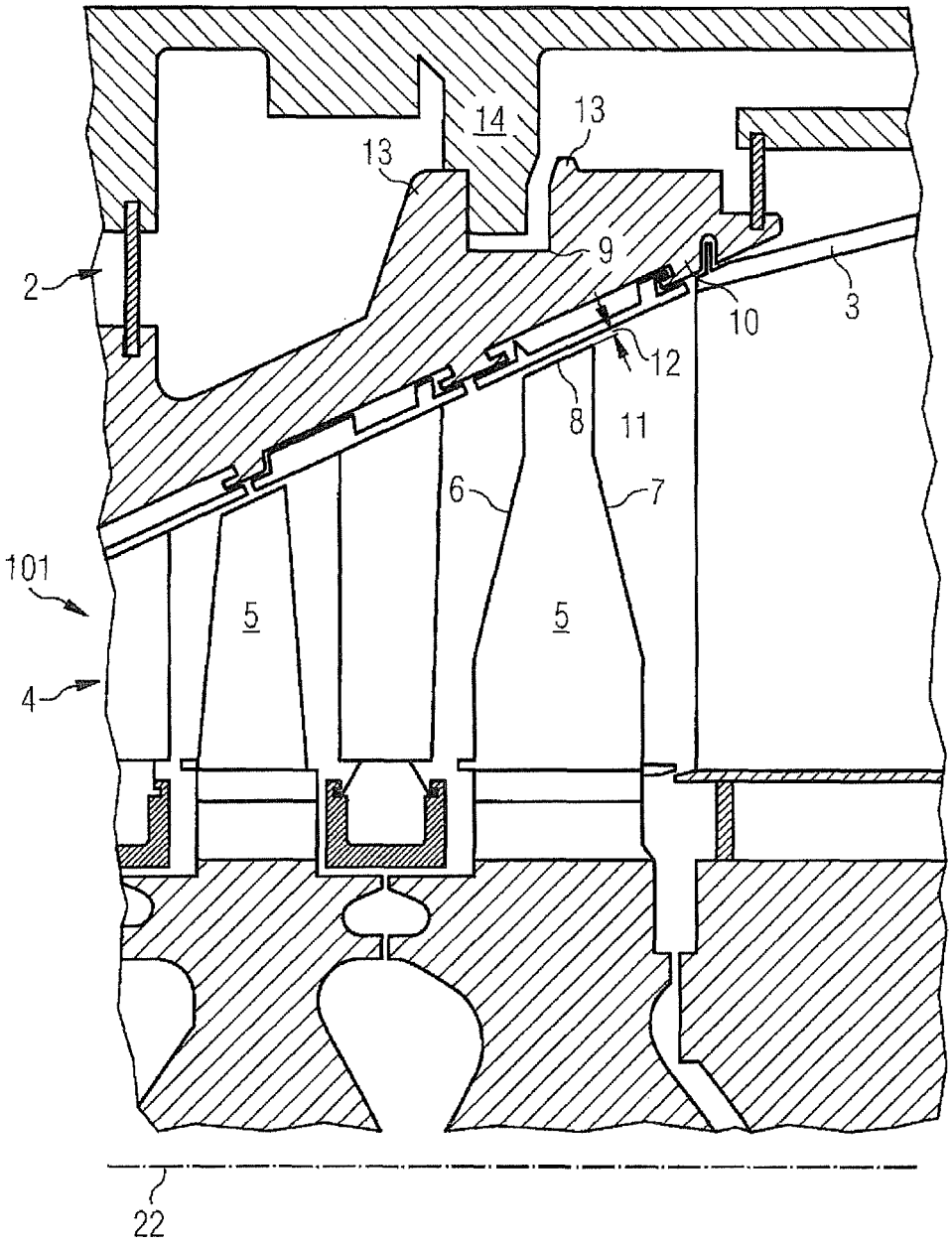
FIG 2 Prior Art
FIG. 2 shows a longitudinal section through a conventional axial turbomachine.

In FIG. 2, a conventional axial turbomachine 101 is shown. The axial turbomachine 101 has a casing 2 with an inner side 3 by which a main flow passage 4 is defined. Arranged in the main flow passage 4 is a rotor blade ring which is formed from a multiplicity of rotor blades 5 which are arranged in a distributed manner around the circumference. Each of the rotor blades 5 has a leading edge 6 upstream and a trailing edge 7 downstream. Radially towards the outside, the rotor blade 5 is delimited by a blade tip 8. The main flow passage 4 is exposed to throughflow from left to right in the main flow direction in FIG. 2, wherein the main flow passage 4 widens in the main flow direction. As a result, the inner side 3 of the casing 2 is arranged in an inclined manner to the axis 22 of the axial turbomachine 101.

Radially in the region of the blade tip 8, provision is made in the casing 2 for a stator blade carrier 10. Facing the axis 22 of the axial turbomachine 101, the stator blade carrier 10 has an annular inner side 11 which extends parallel to the blade tip 8. A radial gap 12 is formed between the annular inner side 11 and the blade tip 10. The stator blade carrier 10 has a radially outwardly extending step 13 which has an outwardly opening, encompassing annular slot 9. Engaging in the annular slot 9 is a radially inwardly extending and encompassing step 14 which is provided on the casing 2. The stator blade carrier 10 is fastened on the casing step 14 by fastening means so that the stator blade carrier 10 is stationary.

Figure 1:
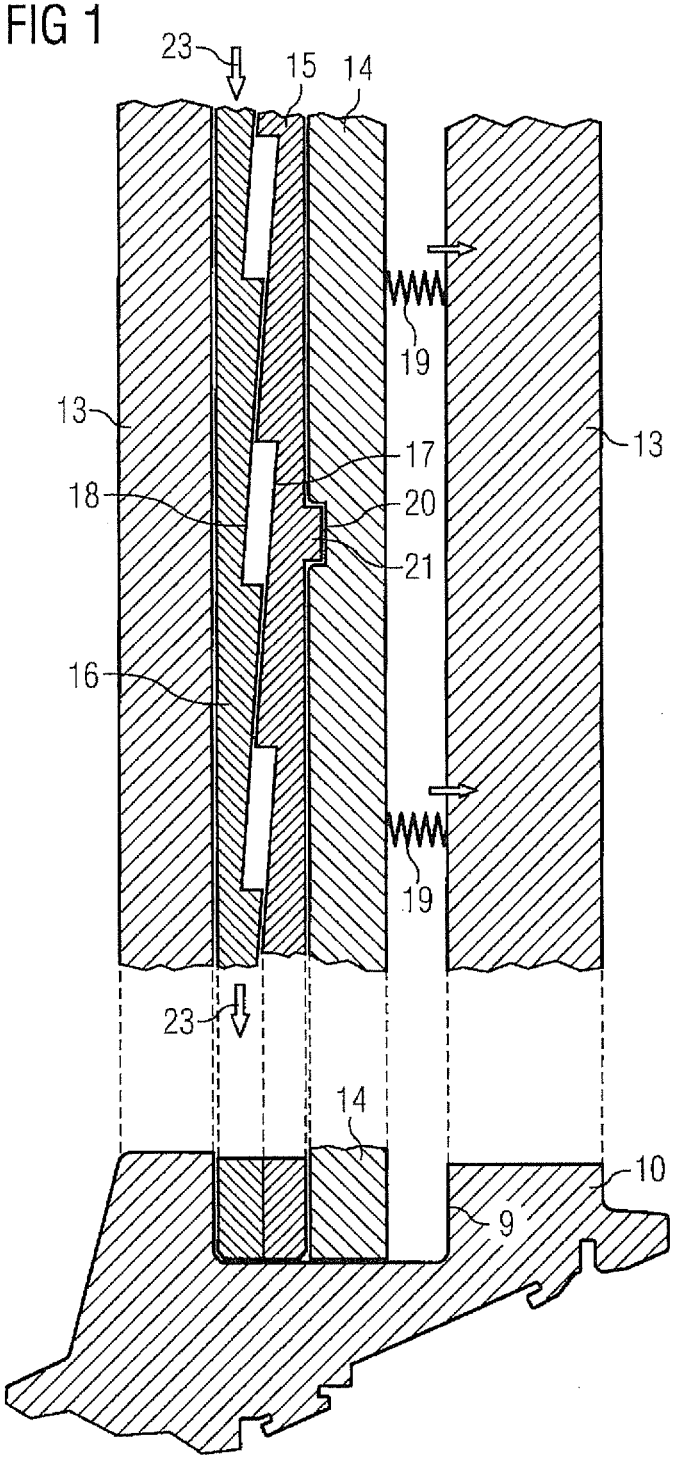
FIG. 1 shows in the bottom section a longitudinal section through the stator blade carrier according to the invention and in the upper section shows a radial section through the stator blade carrier according to the invention.

In FIG. 1, a detail of an axial turbomachine according to the invention is shown. The axial turbomachine according to the invention differs from the conventional axial turbomachine 101, as shown is in FIG. 2, in that the stator blade carrier 10 is arranged on the casing step 14 in an axially displaceable manner. Furthermore, in contrast to the conventional axial turbomachine 101, in the case of the axial turbomachine 1 according to the invention the annular slot 9 is of an axially wider design, wherein a fixing ring 15 and an adjusting ring 16 are additionally arranged in the annular slot 9 upstream of the casing step 14. The fixing ring 15 and the adjusting ring 16 are provided in the annular slot 9 in a side-by-side arrangement, wherein the fixing ring 15 and the adjusting ring 16 are supported in the radial direction by their inside diameters on the base of the annular slot 9.

The fixing ring 15, on its annularly formed side facing the adjusting ring 16, has a first sawtooth profile 17, the edges of which extend radially. In the annularly formed side of the adjusting ring 16 facing the fixing ring 15, a second sawtooth profile 18 is formed as counterpart to the first sawtooth profile 17. The adjusting ring 16, on its side facing away from the second sawtooth profile 18, has a flat annular surface which bears flat against a sidewall of the annular slot 9. The fixing ring 15, on its side facing away from the sawtooth profile 17, has a flat annular surface which bears against the casing step 14, wherein a projection 21 protrudes from this annular surface and engages in a groove 20 which is provided in the casing step 14. The groove 20 and the projection 21 form a form-fitting connection in the circumferential direction so that by the projection 21 the fixing ring 15 is fixed on the casing step 14 in the circumferential direction.

The adjusting ring 16 is rotatably supported in the annular slot 9 relative to the fixing ring 15. During rotation of the adjusting ring 16 in the annular slot 9 relative to the fixing ring 15 in the direction which is indicated by the arrows 23 shown in FIG. 1, the second sawtooth profile 18 is displaced in relation to the first sawtooth profile 17.

On account of the obliquely set flanks of the sawtooth profiles 17 and 18, a varying axial position of the fixing ring 15 with regard to the adjusting ring 16 is created during rotation of the adjusting ring 16. Due to the fact that the fixing ring 15 is supported on the casing step 14 axially in the main flow direction, the adjusting ring 16 is displaced axially against the main flow direction by the fixing ring 15 as a result of the mutual displacement of the sawtooth profiles 17 and 18. On account of the axial supporting of the adjusting ring 16 in the annular slot 9 on the stator blade carrier step 13, the stator blade carrier 10 is displaced axially in the casing 2 against the main flow direction. As a result, the radial gap 12 increases.

If in reverse to this the adjusting ring 16 moves against the arrows 23 which are shown in FIG. 1, then the sawtooth profiles 17, 18 get into tighter engagement, as a result of which the axial extent of the fixing ring 15 and of the adjusting ring 16 becomes smaller. On the side of the casing step 14 facing away from the fixing ring 15, two helical springs 19 are installed in the annular slot 9 and are supported both on the stator blade carrier step 13 and on the casing step 14. As a result, the pressure force which is applied by the helical springs 19 to the stator blade carrier 10 acts in the main flow direction. The pressure force serves as a restoring force for the stator blade carrier 10 so that if the axial extent of the fixing ring 15 together with the adjusting ring 16 is reduced as a result of rotating the adjusting ring 16, the stator blade carrier 10 can follow the adjusting ring 16. Therefore, the stator blade carrier 10 is displaced in the main flow direction and the radial gap 12 decreases.

The base of the annular slot 9 is formed parallel to the axis of the axial turbomachine 1 and the radially inner edge of the casing step 14 bears against the base of the annular slot 9 so that if the stator blade carrier 10, induced by an adjustment of the adjusting ring 16, is moved axially back and forth, the stator blade carrier 10 is supported radially on the casing step 14.

The invention claimed is:

1. An axial turbomachine having a rotor blade cascade, comprising:

a plurality of rotor blades each including a radially outer, unshrouded blade tip which extends in an inclined manner to an axis of the axial turbomachine;

a casing, in which the rotor blade cascade is installed and which by an inner side defines a main flow passage of the axial turbomachine; and a stator blade carrier, which enshrouds the rotor blade cascade, is integrated in the inner side of the casing, and includes a radially inner annular inner side with which on the inner side of the casing the main flow passage is continued, wherein the stator blade carrier is arranged directly adjacent to the blade tips, forming a radial gap between a plurality of envelopes of the blade tips and the annular inner side, wherein the annular inner side extends essentially parallel to the blade tip and the stator blade carrier is mounted in the casing in a manner in which it is displaceable parallel to the axis of the axial turbomachine, wherein provision is made for an adjusting ring which is supported on contact surfaces on the casing and on the stator blade carrier and can be rotated around the axis of the axial turbomachine, and wherein the contact surfaces of the adjusting ring and of the casing and of the stator blade carrier are marginally set with respect to a plane which is perpendicular to the axis of the axial turbomachine in such a way that if the adjusting ring is rotated around the axis of the axial turbomachine the stator blade carrier can be axially displaced by means of the adjusting ring, wherein the stator blade carrier has an outwardly radially extending, encompassing stator blade carrier step with an outwardly open annular slot in which engages an inwardly radially extending, encompassing casing step, wherein the adjusting ring is arranged in the annular slot between the stator blade carrier step and the casing step, and wherein between the adjusting ring and the casing step provision is made for a fixing ring which is fastened on the casing step and interacts with the adjusting ring for axial displacement of the stator blade carrier, and wherein the fixing ring, on a first side facing the adjusting ring, includes a first sawtooth profile and the adjusting ring, on a second side facing the fixing ring, includes a second sawtooth profile, and wherein the first and second sawtooth profiles engage with each other and may slide on each other in such a way that if the adjusting ring is axially rotated the stator blade carrier is axially displaced.

2. The axial turbomachine as claimed in claim 1, wherein the adjusting ring bears against a base of the annular slot, as a result of which the adjusting ring is supported radially by the annular slot during rotation.

3. The axial turbomachine as claimed in claim 1, wherein the fixing ring is fastened on the casing step in a form-fitting manner.

4. The axial turbomachine as claimed in claim 1, wherein provision is made in the annular slot for a pretensioning device which is supported on the casing and acts on the stator blade carrier step in counteraction to the adjusting ring so that by means of the pretensioning device the stator blade carrier step is constantly pressed onto the adjusting ring.

5. The axial turbomachine as claimed in claim 3, wherein the pretensioning device is preferably a helical spring.

6. The axial turbomachine as claimed in claim 1, wherein the annular inner side tapers against the main flow direction and the adjusting ring is arranged on the casing step on an upstream side.

7. The axial turbomachine as claimed in claim 6, wherein the pretensioning device is arranged on the casing step on a downstream side.

8. An axial turbomachine having a rotor blade cascade, comprising:

a plurality of rotor blades each including a radially outer, unshrouded blade tip which extends in an inclined manner to an axis of the axial turbomachine;

a casing, in which the rotor blade cascade is installed and which by an inner side defines a main flow passage of the axial turbomachine; and a stator blade carrier, which enshrouds the rotor blade cascade, is integrated in the inner side of the casing, and includes a radially inner annular inner side with which on the inner side of the casing the main flow passage is continued, wherein the stator blade carrier is arranged directly adjacent to the blade tips, forming a radial gap between a plurality of envelopes of the blade tips and the annular inner side, wherein the annular inner side extends essentially parallel to the blade tip and the stator blade carrier is mounted in the casing in a manner in which it is displaceable parallel to the axis of the axial turbomachine, wherein provision is made for an adjusting ring which is supported on contact surfaces on the casing and on the stator blade carrier and can be rotated around the axis of the axial turbomachine, and wherein the contact surfaces of the adjusting ring and of the casing or of the stator blade carrier are marginally set with respect to a plane which is perpendicular to the axis of the axial turbomachine in such a way that if the adjusting ring is rotated around the axis of the axial turbomachine the stator blade carrier can be axially displaced by means of the adjusting ring, wherein the stator blade carrier has an outwardly radially extending, encompassing stator blade carrier step with an outwardly open annular slot in which engages an inwardly radially extending, encompassing casing step, wherein the adjusting ring is arranged in the annular slot between the stator blade carrier step and the casing step, wherein between the adjusting ring and the casing step provision is made for a fixing ring which is fastened on the casing step and interacts with the adjusting ring for axial displacement of the stator blade carrier, wherein the fixing ring, on a first side facing the adjusting ring, includes a first sawtooth profile and the adjusting ring, on a second side facing the fixing ring, includes a second sawtooth profile, and wherein the first and second sawtooth profiles engage with each other and may slide on each other in such a way that if the adjusting ring is axially rotated the stator blade carrier is axially displaced.

* * * * *